US007806098B2

(12) United States Patent
Bing et al.

(10) Patent No.: US 7,806,098 B2
(45) Date of Patent: Oct. 5, 2010

(54) CYLINDER SLEEVE FOR AN INTERNAL COMBUSTION ENGINE

(75) Inventors: Karlheinz Bing, Remseck (DE); Stefan Spangenberg, Korntal-Münchingen (DE); Georg Schuller, Frankenmarkt (AT)

(73) Assignee: Mahle GmbH, Stuttgart (DE)

( * ) Notice: Subject to any disclaimer, the term of this patent is extended or adjusted under 35 U.S.C. 154(b) by 343 days.

(21) Appl. No.: 10/589,792

(22) PCT Filed: Feb. 18, 2005

(86) PCT No.: PCT/DE2005/000283

§ 371 (c)(1),
(2), (4) Date: Oct. 5, 2006

(87) PCT Pub. No.: WO2005/078265

PCT Pub. Date: Aug. 25, 2005

(65) Prior Publication Data

US 2007/0209627 A1 Sep. 13, 2007

(30) Foreign Application Priority Data

Feb. 18, 2004 (DE) ..... 10 2004 007 774.6

(51) Int. Cl.
*F02F 1/00* (2006.01)

(52) U.S. Cl. ..... 123/193.2; 29/888.061

(58) Field of Classification Search ..... 123/193.1, 123/193.2, 193.3, 668, 41.28, 41.29, 41.67, 123/41.72, 41.79, 41.81, 41.84, 41.74; 29/888.061, 29/888.06; 428/600
See application file for complete search history.

(56) References Cited

U.S. PATENT DOCUMENTS

| | | | | | |
|---|---|---|---|---|---|
| 2,810,378 | A * | 10/1957 | Burch | 123/195 R |
| 4,127,058 | A * | 11/1978 | Rohrle | 92/169.1 |
| 4,419,971 | A * | 12/1983 | Nakamura et al. | 123/193.2 |
| 4,616,603 | A * | 10/1986 | Kubis et al. | 123/41.84 |
| 4,630,345 | A * | 12/1986 | Lutz | 29/888.061 |
| 4,903,652 | A * | 2/1990 | Field et al. | 123/193.2 |
| 5,732,671 | A * | 3/1998 | Takami et al. | 123/193.2 |
| 6,182,629 | B1 * | 2/2001 | Gobbels et al. | 123/193.2 |
| 6,286,210 | B1 | 9/2001 | Rückert et al. | |
| 6,298,818 | B1 * | 10/2001 | Koyama et al. | 123/193.2 |
| 6,557,513 | B1 * | 5/2003 | Hill et al. | 123/193.2 |
| 6,640,765 | B2 | 11/2003 | Land et al. | |
| 6,748,655 | B2 * | 6/2004 | Dickmann et al. | 29/888.061 |
| 6,802,121 | B2 | 10/2004 | Fuganti et al. | |
| 6,920,859 | B2 * | 7/2005 | Oh | 123/193.2 |
| 7,226,667 | B2 * | 6/2007 | Kodama et al. | 428/600 |

(Continued)

FOREIGN PATENT DOCUMENTS

DE 15 76 437 1/1970

(Continued)

*Primary Examiner*—Michael Cuff
*Assistant Examiner*—Hung Q Nguyen
(74) *Attorney, Agent, or Firm*—Collard & Roe, P.C.

(57) ABSTRACT

A cylinder sleeve for an internal combustion engine is provided with a flat zone that extends along the entire axial length thereof. The cylinder sleeve is embodied as a rough cast sleeve whose outer surface comprises a rough zone that extends along the entire axial length thereof and consists of a plurality of elevations with undercuts in order to ensure that a sufficient amount of combustion heat generated during operation of the engine is discharged.

3 Claims, 8 Drawing Sheets

U.S. PATENT DOCUMENTS

Figure 1:
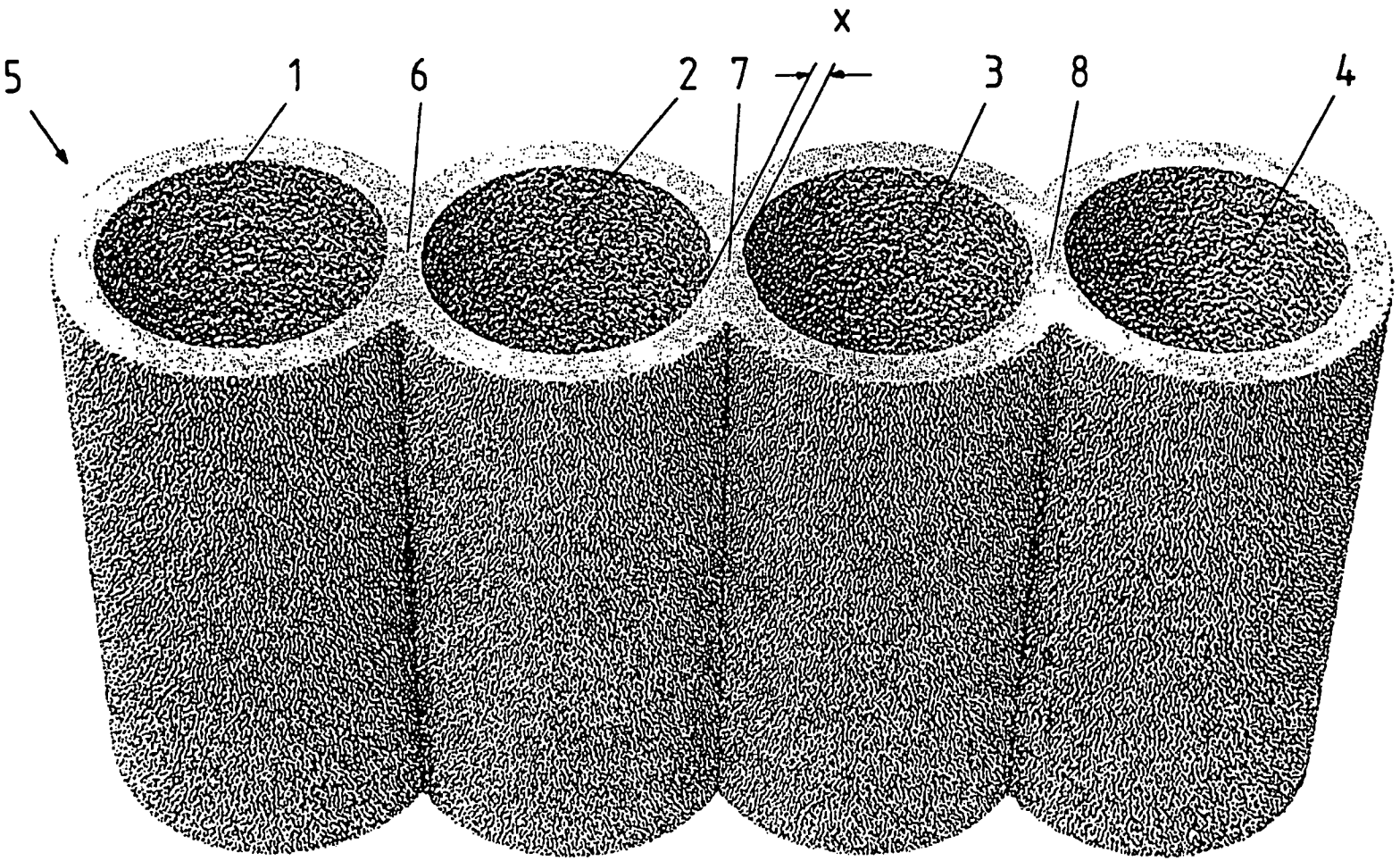

| | | | | |
|---|---|---|---|---|
| 7,392,771 | B2 * | 7/2008 | Sunada et al. | 123/41.74 |
| 2002/0033161 | A1 | 3/2002 | Hoffmann et al. | |
| 2003/0000086 | A1 * | 1/2003 | Fuganti et al. | 29/888.061 |
| 2003/0084567 | A1 * | 5/2003 | Dickmann et al. | 29/888.061 |
| 2005/0150476 | A1 * | 7/2005 | Gohrbandt et al. | 123/193.2 |
| 2005/0161014 | A1 * | 7/2005 | Komai et al. | 123/193.2 |

FOREIGN PATENT DOCUMENTS

| | | | |
|---|---|---|---|
| DE | 24 38 762 | | 3/1976 |
| DE | 198 07 685 | | 9/1999 |
| DE | 198 57 390 | | 4/2000 |
| DE | 199 37 934 | | 2/2001 |
| DE | 199 58 185 | | 6/2001 |
| DE | 100 09 135 | | 8/2001 |
| DE | 101 03 459 | | 9/2001 |
| DE | 101 47 219 | | 4/2003 |
| DE | 102 35 910 | | 2/2004 |
| DE | 601 00 457 | | 5/2004 |
| EP | 0 110 406 | | 6/1984 |
| EP | 0 837 235 | | 4/1998 |
| JP | 2002 097998 | | 4/2002 |
| WO | WO2004074667 | * | 9/2004 |

* cited by examiner

CYLINDER SLEEVE FOR AN INTERNAL COMBUSTION ENGINE

CROSS REFERENCE TO RELATED APPLICATIONS

Applicants claim priority under 35 U.S.C. §119 of German Application No. 10 2004 007 774.6 filed Feb. 18, 2004. Applicant also claims priority under 35 U.S.C. §365 of PCT/DE2005/000283 filed on Feb. 18, 2004. The international application under PCT article 21(2) was not published in English.

The invention relates to a cylinder sleeve for an internal combustion engine, according to the preamble of claim 1.

A cylinder sleeve in accordance with the preamble of the main claim, made of iron, is known from the European patent document EP 0 837 235 B1, which sleeve is cast into an engine block made of aluminum, by way of its lower region, and has engagement segments that run over the circumference of the sleeve, in this region, which segments are vise-shaped in cross-section, and serve to anchor the sleeve in the material of the engine block. In this way, a gap is prevented from forming between the cylinder sleeve and the engine block as the cylinder sleeve and the engine block warm up, due to the different expansion coefficients of iron and aluminum, which gap can result in deterioration of the heat elimination by way of the engine block, in overheating of the cylinder sleeve, and thereby in damage to the latter.

However, in this connection, only the lower sleeve region, which is subject to relatively less stress, in terms of temperature, is cast into the engine block. The upper region of the cylinder sleeve is subject to much greater stress, in terms of temperature, since combustion takes place here, and since the cylinder sleeves are disposed very closely next to one another, because of their laterally flattened regions. For this reason, according to the state of the art, this region is surrounded by a gap into which water is introduced to cool this region of the cylinder sleeve. This results in a very complicated design, which furthermore offers little strength for the upper region of the cylinder sleeve, on which the forces that result from the ignition pressure of the combustion that takes place here act, and which is surrounded exclusively by a water mantle.

It is therefore the task of the invention to create a cylinder sleeve having a laterally flattened region, which sleeve can be disposed so as to save space, and is configured in such a manner that it nevertheless can be completely cast into an engine block, without temperature problems occurring during engine operation, due to lack of heat elimination.

This task is accomplished with the characteristics standing in the characterizing part of the main claim. Practical embodiments of the invention are the object of the dependent claims.

In this connection, the roughened region on the outer surface of the rough-cast sleeve offers a very large outer surface standing in contact with the material of the engine block, by way of which the combustion heat can be conducted away well. Furthermore, the plurality of elevations with undercuts results in tight clamping between sleeve and engine block, which prevents the formation of a thermally insulating gap between sleeve and engine block in the case of different expansion coefficients due to different materials of sleeve and engine block.

Figure 2:
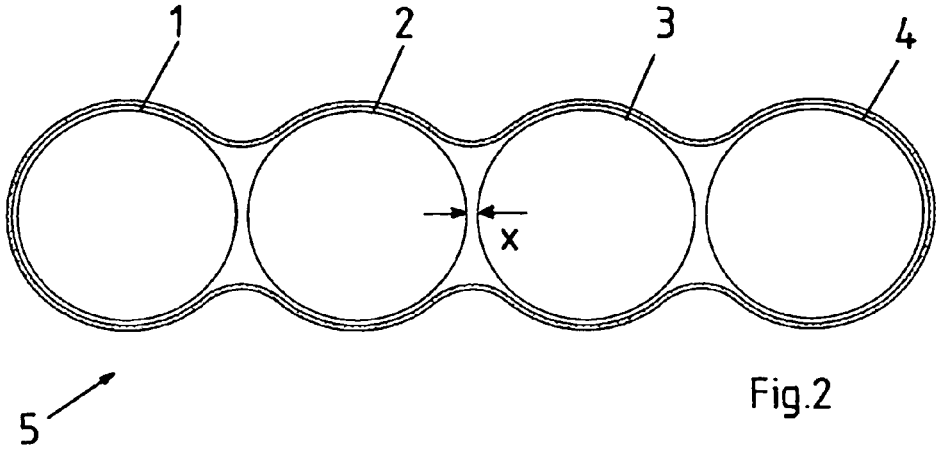
Figure 3:
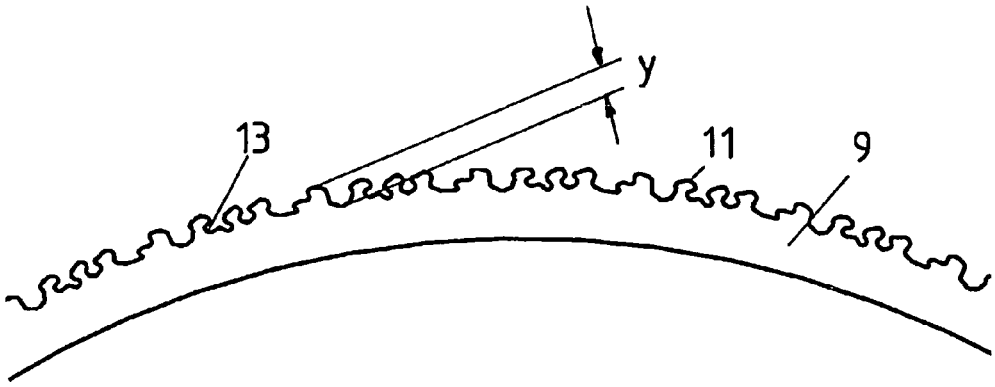
Figure 4:
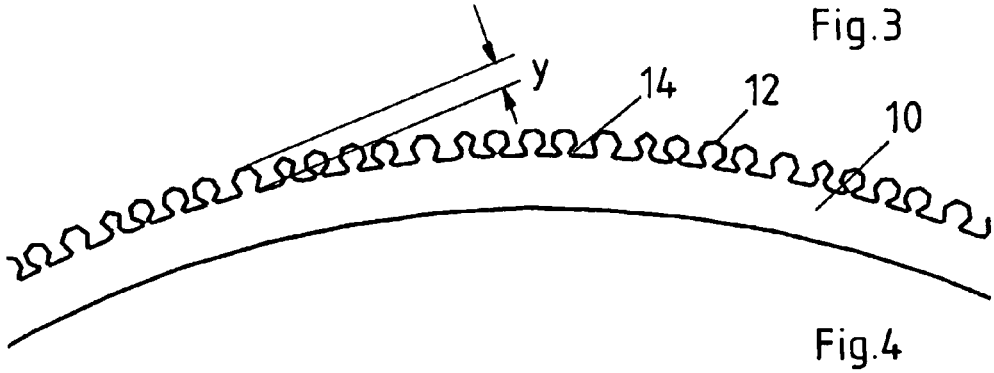
Figures 5, 6, 7:
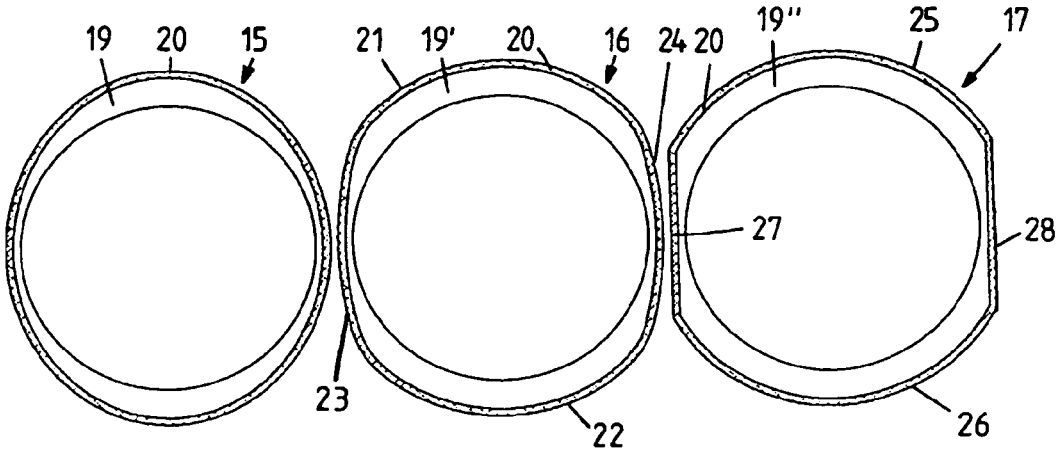
Figure 8:
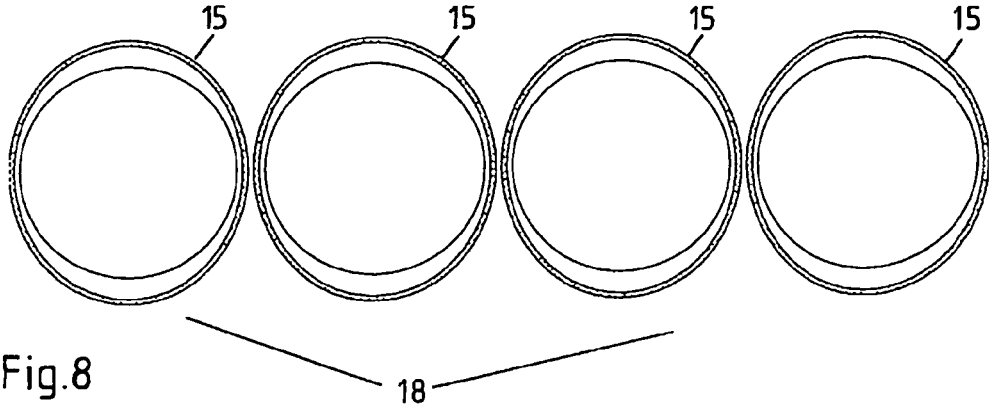
Figure 9:
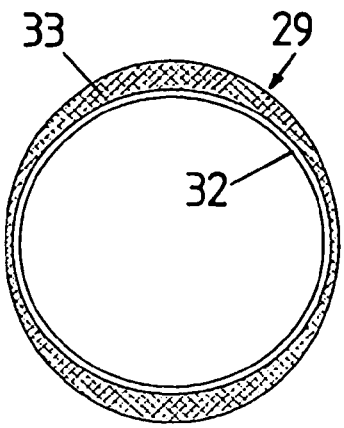
Figure 10:
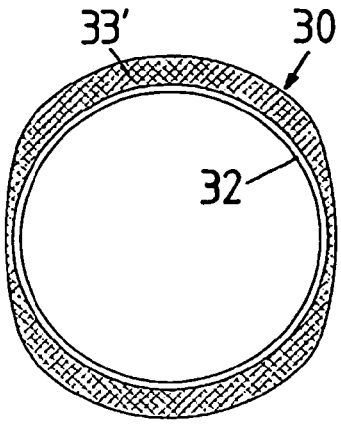
Figure 11:
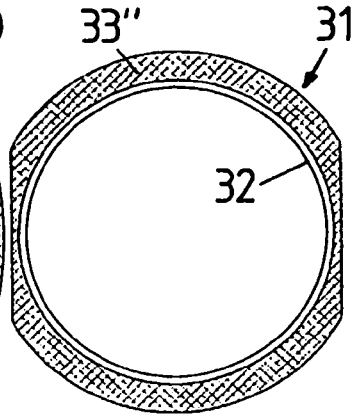
Figure 12:
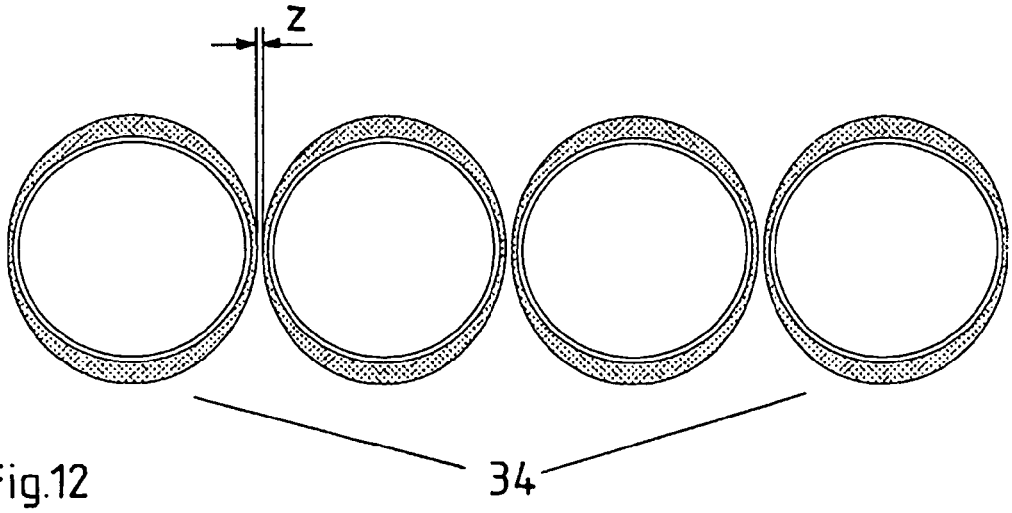
Figures 13, 14, 15:
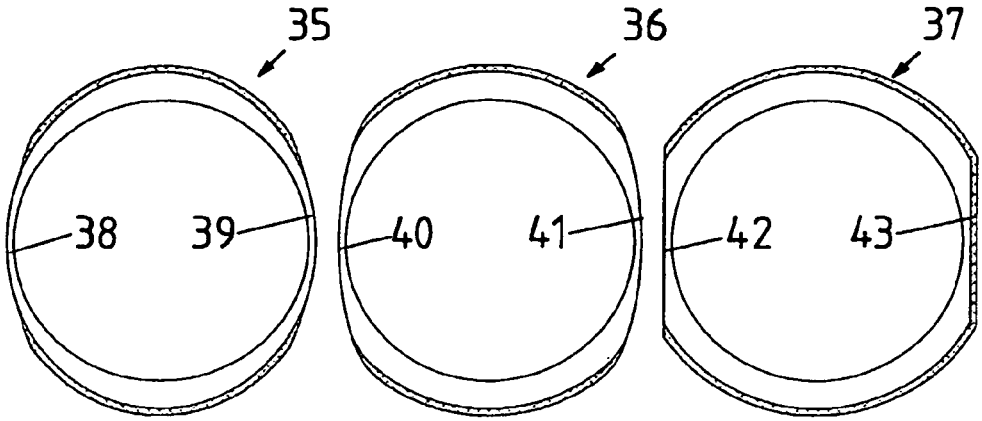
Figure 16:
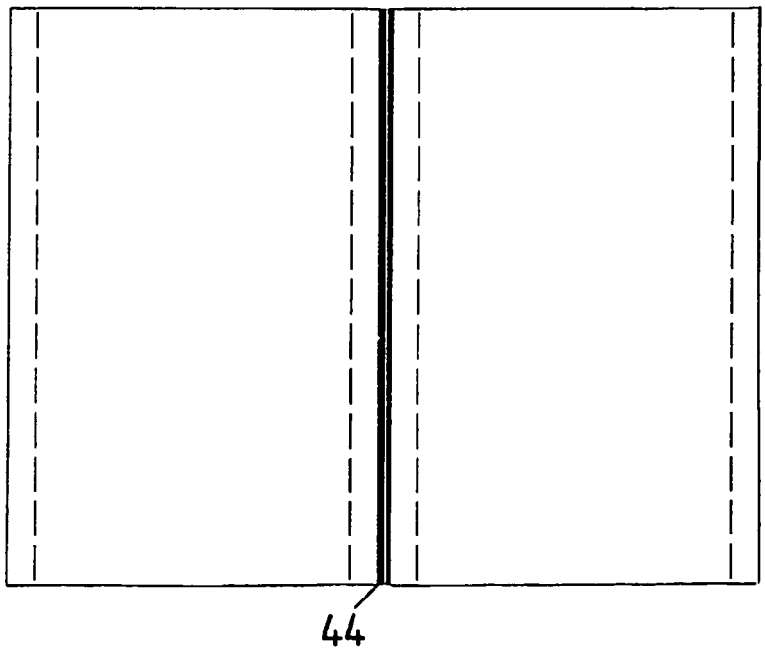
Figure 17:
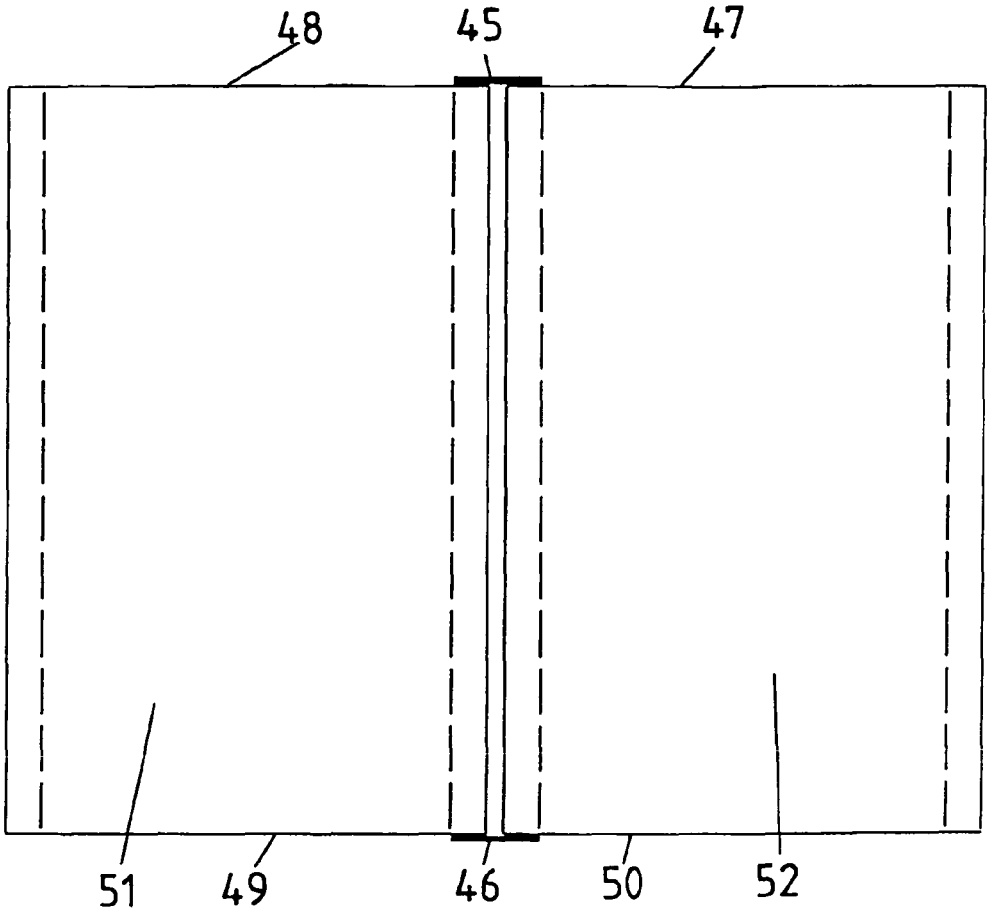
Figure 18:
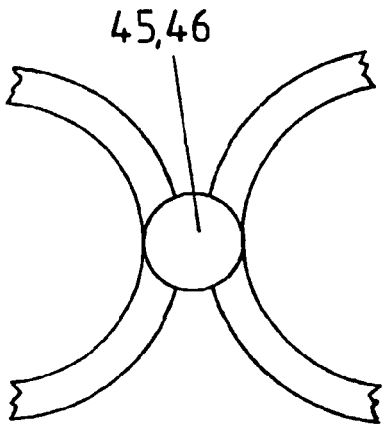
Figure 19:
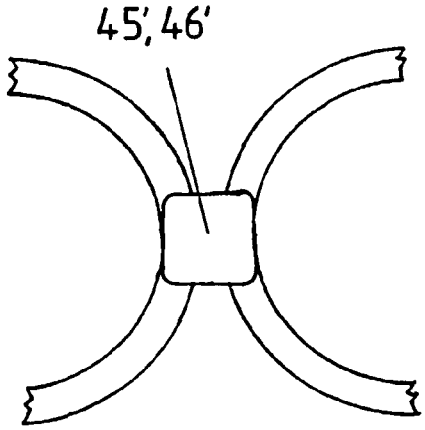
Figure 20:
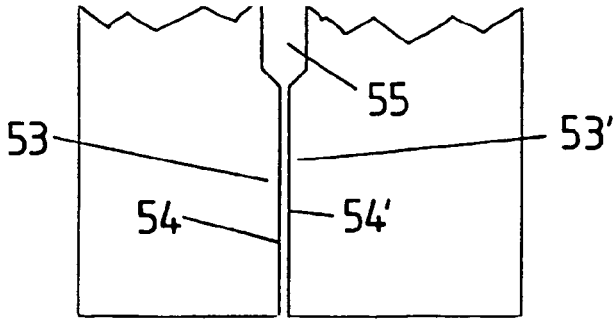
Figure 21:
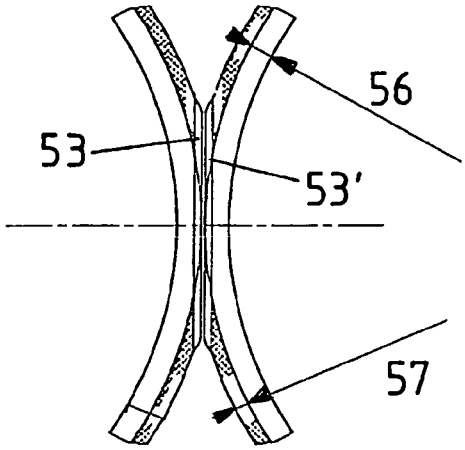
Figure 22:
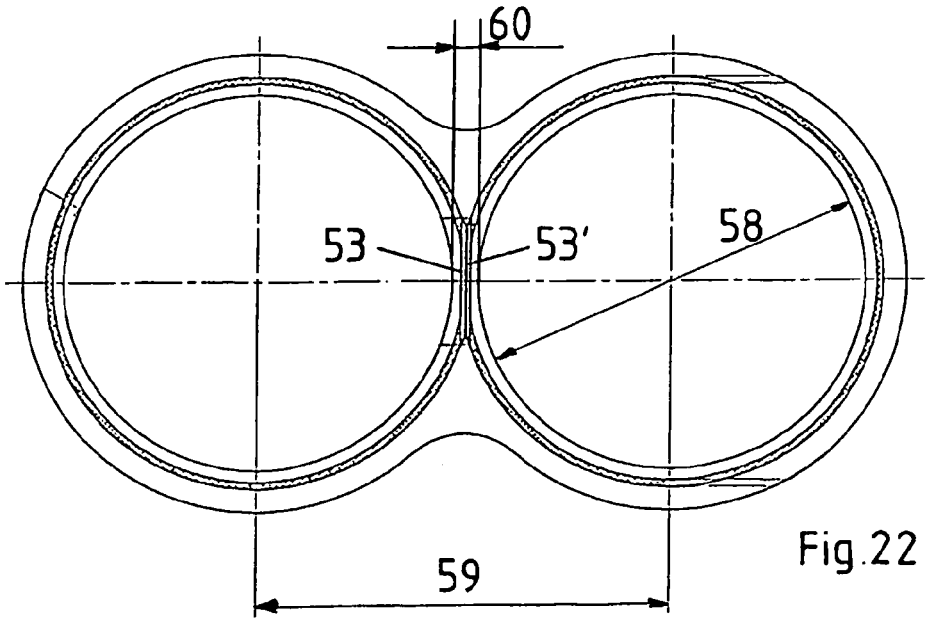
Figure 23:
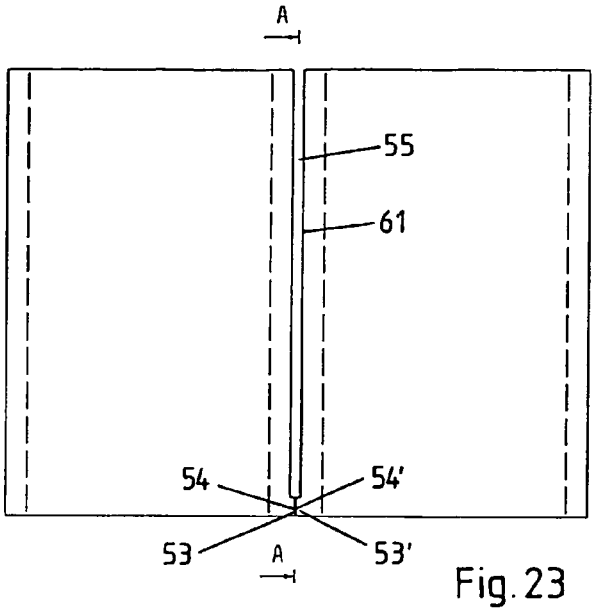
Figure 24:
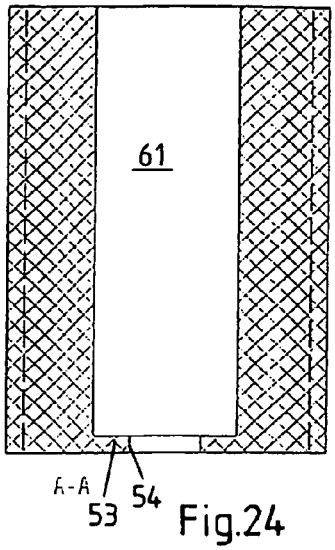
Figure 25:
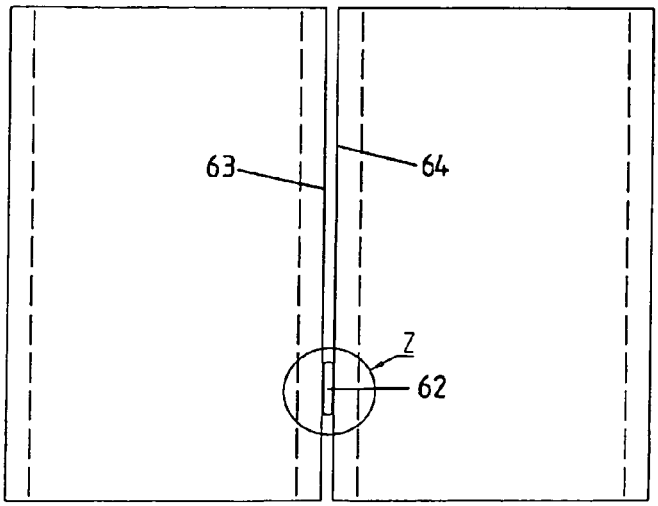
Figure 26:
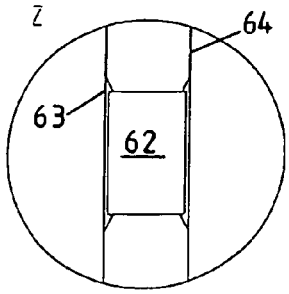

Some exemplary embodiments of the invention will be described in the following, using the drawings. These show:

FIG. 1 a sleeve package consisting of 4 rough-cast sleeves, for use in a four-cylinder engine, FIG. 2 the rough-cast sleeve package according to FIG. 1 in a top view, FIGS. 3, 4 enlarged cross-sections through parts of the sleeve wall, with configuration possibilities of its surface roughness, FIGS. 5-7 configurations of rough-cast sleeves with a variable sleeve wall thickness and constant depth of the roughened region, FIG. 8 an arrangement of 4 rough-cast sleeves having an elliptical outside contour, according to FIG. 5, for use in a four-cylinder engine, FIGS. 9-11 configurations of rough-cast sleeves having a constant sleeve wall thickness and variable depth of the roughened region, FIG. 12 an arrangement of 4 rough-cast sleeves having an elliptical outside contour, according to FIG. 9, for use in a four-cylinder engine, FIGS. 13-15 configurations of flattcncd rough-cast sleeves having a variable sleeve wall thickness, constant depth of the roughened region, and without rough-cast structures on the outer surfaces of those sleeve regions that lie opposite one another in the case of the rough-cast sleeves combined to form sleeve packages, FIG. 16 two rough-cast sleeves joined together, FIG. 17 two rough-cast sleeves joined together using two bridges, FIG. 18 a configuration of a bridge for joining rough-cast sleeves, FIG. 19 another configuration of a bridge for joining rough-cast sleeves, FIG. 20-24 rough-cast sleeves having one flattened region each, which has a step in its lower region, FIG. 25 two rough-cast sleeves joined together, having a spacer between the flattened regions, FIG. 26 an enlarged representation of the spacer according to FIG. 25.

FIG. 1 shows, in a perspective view, and FIG. 2 shows, in a top view, a sleeve package 5 consisting of four rough-cast sleeves 1 to 4. The 4 rough-cast sleeves 1 to 4 have roughened outer surfaces over their entire axial length. In this connection, the common wall regions 6 to 8 of adjacent sleeves 1 to 4 have a land width x that corresponds to the other wall thickness of the rough-cast sleeves 1 to 4.

The entire sleeve package 5 is produced in a single casting process, from an aluminum-silicon alloy, whereby the gravity casting method or the "lost-foam" casting method is used. Both of these casting methods are known from the state of the art (see DE 199 58 185 A1 with regard to the "lost-foam" casting method), and will not be explained in greater detail here. In the production of an engine block, the entire sleeve package 5 is set into the casting mold provided for this purpose, and casting material is cast around it.

The cross-sections 9 and 10 through parts of the wall of the rough-cast sleeves, shown in FIGS. 3 and 4, show configurations of the roughened region, whereby the roughened region according to cross-section 9 has elevations 11 distributed in irregular manner, and the roughened region according to cross-section 10 has elevations 12 distributed in regular manner. In both cases, the elevations 10 and 11 are shaped in such a manner that undercuts 13 and 14 are formed by them, the function of which consists in anchoring the rough-cast sleeves in the casting material of the engine block. The height of the elevations 11 and 12 and thereby the depth y of the roughened region have a value of 0.2 to 2 mm.

The rough-cast sleeves shown in cross-section in FIGS. 5 to 15. The sleeves have two contact regions that lie opposite one another and reach over their entire axial length. In other words, the contact regions are regions where the rough-cast sleeves contact each other. The radially outer surface of the contact regions have a lesser radial distance from the longitudinal axes of the sleeves than the radially outer surface of the other two regions. The rough cast sleeves can consist of cast iron and are then preferably produced using the spin casting method. However, they can also consist of an aluminum-silicon alloy, which opens up the possibility of producing the rough-cast sleeves using the gravity casting method, the spin casting method, or the "lost-foam" casting method. Finally, there is the possibility of producing the rough-cast sleeves from a sintered metal. In this connection, the sleeves can already obtain their final shape, within the framework of the casting process. However, there is also the possibility of shaping the sleeves after casting, such as shown in FIGS. 5-15, by means of mechanical machining (milling).

In the production of an engine block from light metal, such as, for example, from aluminum, magnesium, or an alloy of these metals, there is the possibility, for one thing, of setting the sleeves onto spindle sleeves of the casting mold, orienting them in such a manner that the contact regions of the sleeves lie against one another, and then casting the light metal of the engine block around them. For another thing, the sleeves can be joined to one another by way of their contact regions, i.e. welded, soldered, or glued to one another by way of the mantle surfaces of the contact area, so that eyeglass-shaped arrangements of the sleeves result, in cross-section. The sleeve packages obtained in this manner are then laid into the casting mold and the light metal of the engine block is cast around them.

The following configuration possibilities of rough-cast sleeves, shown in FIGS. 5 to 7, 9 to 11, and 13 to 15, are possible: FIG. 5: A sleeve 15 having an elliptical outer shape in cross-section, variable thickness of the sleeve wall 19, and constant depth of the roughened region 20 is shown.

FIG. 6: A sleeve 16 having a variable thickness of the sleeve wall 19', with a constant depth of the roughened region 20, and an outer shape that consists of four arc-shaped segments 21 to 24 of approximately equal size, whereby thicker regions of the sleeve wall 19' delimit the segments 21 and 22 that lie opposite one another, and thinner regions of the sleeve wall 19', delimit the segments 23 and 24 that lie opposite one another, towards the outside, is shown.

FIG. 7: A sleeve 17 having a variable thickness of the sleeve wall 19", with a constant depth of the roughened region 20 and an outer shape that is composed, in cross-section, of two arc-shaped segments 25 and 26 that lie opposite one another, and two contact segments 27 and 28 that like opposite one another, is shown. In this connection, the contact regions of the sleeve 17 that lie opposite one another are delimited, towards the outside, by the segments 27 and 28.

FIG. 8 shows a possibility of disposing the rough-cast sleeves 15 having an elliptical contour next to one another, in space-saving manner, so that a sleeve package 18 that is suitable for a four-cylinder engine is obtained. In this connection, the regions of the elliptical contour next to the axis delimit the contact regions of the sleeves 15, which regions lie at a distance opposite one another in the arrangement of the sleeves 15 to form a sleeve package 18.

FIG. 9: A sleeve 29 having a constant thickness of the sleeve wall 32, with a variable depth of the roughened region 33 and with an elliptical outer contour in cross-section, which is the same as the outer shape of the sleeve 15 according to FIG. 5, is shown.

FIG. 10: A sleeve 30 having a constant thickness of the sleeve wall 32, with a variable depth of the roughened region 33', and with an outer contour consisting of two arc-shaped segments, in cross-section, which contour is the same as the outer shape of the sleeve 16 according to FIG. 6, is shown.

FIG. 11: A sleeve 31 having a constant thickness of the sleeve wall 32, with a variable depth of the roughened region 33", and an outer contour formed from two arc-shaped segments and two flat segments, which lie opposite one another, in each instance, which contour is the same as the outer shape of the sleeve 17 shown in FIG. 7, is shown.

The rough-cast sleeves 29 to 31 shown in FIG. 9 to 11 are produced using the spin casting method, whereby the variation of the depth of the roughened regions 33, 33', and 33" can be achieved by means of a corresponding adjustment of the process parameters.

FIG. 12 shows an arrangement of 4 of the rough-cast sleeves 29 shown in FIG. 9 to form a sleeve package 34 similar to the sleeve package 18 shown in FIG. 8, for use in a four-cylinder engine. In this connection, the rough-cast sleeves of the type shown can be disposed at a distance z of 0.5 to 0.05 mm next to one another.

FIG. 13: A sleeve 35 having a variable sleeve wall thickness, constant depth of the roughened region, and an elliptical outer contour, which is the same as the outer contour of the sleeve 15 shown in FIG. 5, is shown. In this connection, the contact sleeve regions 38 and 39 that lie opposite one another do not have any rough-cast structures.

FIG. 14: A sleeve 36 having a variable sleeve wall thickness, constant depth of the roughened region, and an outer contour consisting of several arc-shaped segments, in cross-section, which contour is the same as the outer shape of the sleeve 16 shown in FIG. 6, is shown. The contact sleeve regions 40 and 41 that lie opposite one another do not have any rough-cast structures.

FIG. 15: A sleeve 37 having a variable sleeve wall thickness, constant depth of the roughened region, and an outer contour consisting of two arc-shaped and two flat segments, in cross-section, which contour is the same as the outer shape of the sleeve 17 shown in FIG. 7, is shown. In this connection, if the sleeve is the first or last element of a sleeve package disposed in a row, a flat segment 43 of the outer contour can be provided with a rough-cast structure, and the segment 42 that lies opposite the former can be configured without a rough-cast structure. In this connection, those segments 38 to 42 of the outer contours of the rough-cast sleeves 35 to 37 that have no rough-cast structures can already be produced within the framework of the casting process. However, it is also possible to provide the entire mantle surface of the sleeve with a rough-cast structure and to subsequently mill away the rough-cast structures of the sleeve contact regions.

The sleeves 17, 31, and 37 shown in FIGS. 7, 11, and 15, the outer contours of which have the flat segments 27, 28, 42, and 43, can be joined to one another by way of these segments, by means of gluing, soldering, or welding, so that sleeve structures that are eyeglass-shaped in cross-section result. This brings with it the advantage that in the production of engine blocks, several sleeves can be placed into the casting machine at the same time, thereby accelerating the production of the engine blocks and making it less expensive. According to FIG. 16, a glue or solder layer 44, in each instance, is applied to the opposite region of the sleeves, in this connection, before the sleeves are joined together.

Another possibility of connecting sleeves with one another before they are cast into an engine block is shown in FIG. 17. In this connection, bridges 45 and 46 are used, which are glued or soldered onto adjacent regions of the faces 47 and 48, i.e. 49 and 50 of the sleeves 51 and 52, respectively, and thereby connect the sleeves 51 and 52.

According to FIG. 18, the bridges 45, 46 can have the shape of round disks. According to FIG. 19, however, the bridges

45', 46' can also be given the shape of rectangular slices. The bridges are produced from light metal or from a light metal alloy.

If sleeves are attached to spindle sleeves before being cast, the gap between the sleeves cannot be at just any desired value of narrowness, so that the light metal of the engine block flows through the gap between the sleeves, fills the space between the sleeves, and creates a firm connection between the sleeves after having cooled. If sleeves are flattened on opposite mantle regions, it is necessary, for this purpose, to ensure that the sleeves always assume a clearly defined position of rotation when mounted on the spindle sleeves, so that the gap between the flattened regions of the sleeves maintains its maximal width and is not reduced in size or completely closed off by sleeves that have been partially turned. This can be achieved in that the flattened regions of the sleeve mantle surfaces that lie opposite one another have steps 53, 53' in their lower regions, facing the crankshaft, which steps are shown in a side view in FIGS. 20, 23, and 24, and in a top view in FIGS. 21 and 22. The steps 53, 53' also have flattened regions 54, 54' (FIGS. 20, 23, 24), which must be oriented parallel to one another when the sleeves are pushed onto spindle sleeves, so that the sleeves fit onto the spindle sleeves, and which thereby ensure that the sleeves always assume a clearly defined position of rotation relative to one another. In addition, the sleeves can be joined to one another, i.e. glued or soldered to one another, by way of the flattened regions 54, 54' of the steps 53, 53'.

Ideally, the width of the gap 55 is 1 mm to 3.5 m in the case of a rough-cast sleeve having a wall thickness 56 of 2.5 mm and a depth 57 of the roughened region of 1.5 mm. The land width 60 is 5.5 mm in the case of sleeves having a cylinder diameter 58 of 82 mm. In this connection, a cylinder distance 59 of 87.5 mm can be achieved.

In FIG. 23, the flattened region 61 formed into the sleeve mantle surface can be seen well in a side view, and in FIG. 24, it can be seen well in a top view; in contrast to the remaining sleeve mantle surface, it does not have any roughened region.

Another solution for the problem of keeping the contact areas of the rough-cast sleeves at a distance and of ensuring that the sleeves are disposed in a clearly defined position of rotation relative to one another consists, according to FIGS. 25 and 26, of a spacer 62 disposed between the contact regions 63 and 64. This has the additional advantage that space is available between the contact regions 63 and 64 of the sleeves being held at a distance from one another, for cooling bores to be made in the engine block.

According to a configuration of the rough-cast sleeves not shown in the figures, regions of the outer surfaces of sleeves disposed next to one another, which surfaces lie opposite one another, can be configured in concave manner.

REFERENCE SYMBOL LIST x land width
y depth of the roughened region
z distance between two rough-cast sleeves
1 to 4 rough-cast sleeve
5 sleeve package
6 to 8 wall region
9, 10 cross-section
11, 12 elevation
13, 14 undercut
15 to 17 sleeve, cylinder sleeve
18 sleeve package
19, 19' 19" sleeve wall
20 roughened region
21 to 24 segment of the outer shape of the sleeve 16
25 to 28 segment of the outer shape of the sleeve 17
29 to 31 sleeve, cylinder sleeve
32 sleeve wall
33, 33', 33" roughened region
34 sleeve package
35 to 37 sleeve, cylinder sleeve
38, 39 contact region of the sleeve 35
40, 41 contact region of the sleeve 36
42, 43 segment of the outer contour of the sleeve 37
44 adhesive or solder layer
45, 45', 46, 46' bridge
47 to 50 face
51, 52 sleeve, cylinder sleeve
53, 53' step
55, 54' flattened region of the step 53
55 gap width
56 wall thickness
57 depth of the roughened region
58 cylinder diameter
60 land width
61 contact region
62 spacer
63, 64 contact region

The invention claimed is:

1. A cylinder sleeve for an internal combustion engine, an outer surface of which has at least one contact area or two contact regions that lie opposite one another reaching over an entire axial length of said cylinder sleeve, a radially outer surface of said cylinder sleeve has a lesser radial distance from a longitudinal axis of said sleeve than a radially outer surface of a rest of said sleeve surface, an outer contour that is elliptical in cross-section and is formed by a depth of a roughened region that varies over a circumference, said cylinder sleeve having a constant sleeve wall thickness, wherein said cylinder sleeve is configured as a rough-cast sleeve, said outer surface of which has said roughened region reaching over its entire axial length and consisting of a plurality of elevations with undercuts and wherein a height of said elevations is between 0.2 mm to 2 mm.

2. The cylinder sleeve according to claim 1, wherein the contact area or two contact regions are provided with a step having a flattened region lying radially on the outside, on its lower side facing a crankcase.

3. A cylinder sleeve for an internal combustion engine, an outer surface of which has one contact area or two contact regions that lie opposite one another, reaching over an entire axial length of said cylinder sleeve, a radially outer surface of said cylinder sleeve has a lesser radial distance from a longitudinal axis of the sleeve than a radially outer surface of a rest of said sleeve surface, and an outer contour that consists, in cross section, of four arc shaped segments that are approximately the same size, wherein the radially outer surface of said arc-shaped segment or of two arc-shaped segments that lie opposite one another has a lesser radial distance from said longitudinal axis of said cylinder sleeve than a radially outer surface of the other arc-shaped segments, and which is formed by a depth of a roughened region that varies over a circumference, said sleeve having a constant sleeve wall thickness, wherein the cylinder sleeve is configured as a rough-cast sleeve, the outer surface of which has the roughened region reaching over its entire axial length and consisting of a plurality of elevations with undercuts and wherein a height of the elevations is between 0.2 mm to 2 mm.

* * * * *